US009488330B2

(12) United States Patent
Pickard et al.

(10) Patent No.: US 9,488,330 B2
(45) Date of Patent: Nov. 8, 2016

(54) DIRECT AISLE LIGHTER

(75) Inventors: Paul Kenneth Pickard, Morrisville, NC (US); Elizabeth Rodgers, Raleigh, NC (US); Patrick O'Flaherty, Morrisville, NC (US)

(73) Assignee: CREE, INC., Durham, NC (US)

( * ) Notice: Subject to any disclaimer, the term of this patent is extended or adjusted under 35 U.S.C. 154(b) by 1003 days.

(21) Appl. No.: 13/453,942

(22) Filed: Apr. 23, 2012

(65) Prior Publication Data

US 2013/0279159 A1 Oct. 24, 2013

(51) Int. Cl.

| | |
|---|---|
| ***F21V 7/00*** | (2006.01) |
| ***F21V 19/00*** | (2006.01) |
| ***F21S 2/00*** | (2016.01) |
| ***F21V 17/00*** | (2006.01) |
| ***F21V 29/505*** | (2015.01) |
| *F21Y 101/02* | (2006.01) |
| *F21Y 103/00* | (2016.01) |
| *F21Y 113/00* | (2016.01) |
| *F21V 29/76* | (2015.01) |

(52) U.S. Cl.

CPC ..... *F21V 7/005* (2013.01); *F21S 2/00* (2013.01); *F21V 17/005* (2013.01); *F21V 19/005* (2013.01); *F21V 29/505* (2015.01); *F21V 29/76* (2015.01); *F21Y 2101/02* (2013.01); *F21Y 2103/003* (2013.01); *F21Y 2113/005* (2013.01)

(58) Field of Classification Search

CPC .... F21V 7/005; F21V 29/505; F21V 17/005; F21V 19/005

See application file for complete search history.

(56) References Cited

U.S. PATENT DOCUMENTS

| | | | |
|---|---|---|---|
| 5,823,663 A | 10/1998 | Bell et al. | 362/362 |
| 6,210,025 B1 | 4/2001 | Schmidt et al. | 362/362 |
| 7,049,761 B2 | 5/2006 | Timmermans et al. | 315/246 |
| 7,213,940 B1 | 5/2007 | Van de Ven et al. | 362/231 |
| 7,510,299 B2 | 3/2009 | Timmermans et al. | 362/225 |

(Continued)

FOREIGN PATENT DOCUMENTS

| | | |
|---|---|---|
| EP | 1298383 A2 | 4/2003 |
| EP | 1847762 A2 | 10/2007 |
| JP | 2011018571 | 8/2011 |
| JP | 2011018572 | 8/2011 |
| WO | WO2011140353 A2 | 11/2011 |

OTHER PUBLICATIONS

Office Action from Japanese Design Patent Application No. 2011-18570.

(Continued)

*Primary Examiner* — Anne Hines

(74) *Attorney, Agent, or Firm* — Koppel, Patrick, Heybl & Philpott

(57) ABSTRACT

A direct lighting fixture that is well-suited for use with solid state light sources, such as LEDs, and particularly useful for lighting aisles in commercial and industrial environments. An elongated housing comprises several integral elements including a heat sink, opposing side reflectors, and a mount surface. A plurality of light sources is disposed on the mount surface. Each light source or cluster of sources has an optical element such as a lens over it to redirect a portion of the light emitted from the sources in a desired direction, for example, to collimate the light. Reflective elements are placed on both sides of each light source or cluster to redirect light that is initially emitted in a longitudinal direction. The fixture may comprise multiple elongated housings connected together and aligned in parallel along the longitudinal direction. The fixture may also be scalable.

25 Claims, 5 Drawing Sheets

(56) References Cited

U.S. PATENT DOCUMENTS

| | | | | |
|---|---|---|---|---|
| 7,712,918 | B2 | 5/2010 | Siemiet et al. | 362/241 |
| 7,722,220 | B2 | 5/2010 | Van de Ven | 362/294 |
| 7,768,192 | B2 | 8/2010 | Van de Ven et al. | 313/503 |
| 7,815,338 | B2 | 10/2010 | Siemiet et al. | 362/218 |
| 8,092,049 | B2 | 1/2012 | Kinnune et al. | 362/294 |
| 2004/0001344 | A1* | 1/2004 | Hecht | 362/555 |
| 2007/0115670 | A1 | 5/2007 | Roberts et al. | |
| 2007/0115671 | A1 | 5/2007 | Roberts et al. | |
| 2009/0225543 | A1 | 9/2009 | Roberts et al. | |
| 2009/0323334 | A1 | 12/2009 | Roberts et al. | |
| 2011/0199005 | A1 | 8/2011 | Bretschneider et al. | |
| 2011/0199769 | A1 | 8/2011 | Bretschneider et al. | |
| 2012/0051041 | A1* | 3/2012 | Edmond et al. | 362/231 |

OTHER PUBLICATIONS

Reason for Rejection from Japanese Design Patent Application No. 2011-18571.

Reason for Rejection from Japanese Design Patent Application No. 2011-18572.

U.S. Appl. No. 12/873.303, filed Aug. 31, 2010 to Edmond, et al.

U.S. Appl. No. 12/961,385, filed Dec. 6, 2010 to Pickard, et al.

Cree's XLamp XP-E LED's, data sheet, pp. 1-16.

Cree's XLamp XP-G LED's, data sheet. pp. 1-12.

International Search Report and Written Opinion for Patent Application No. PCT/US2011/001517, dated: Feb. 27, 2012.

* cited by examiner

FIG. 1
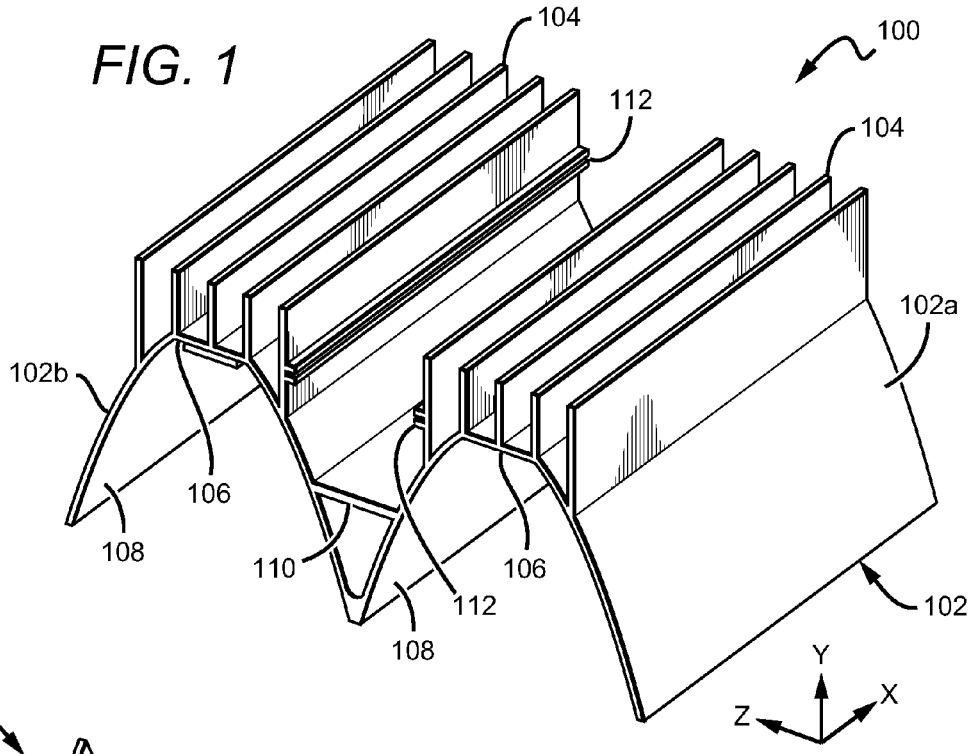
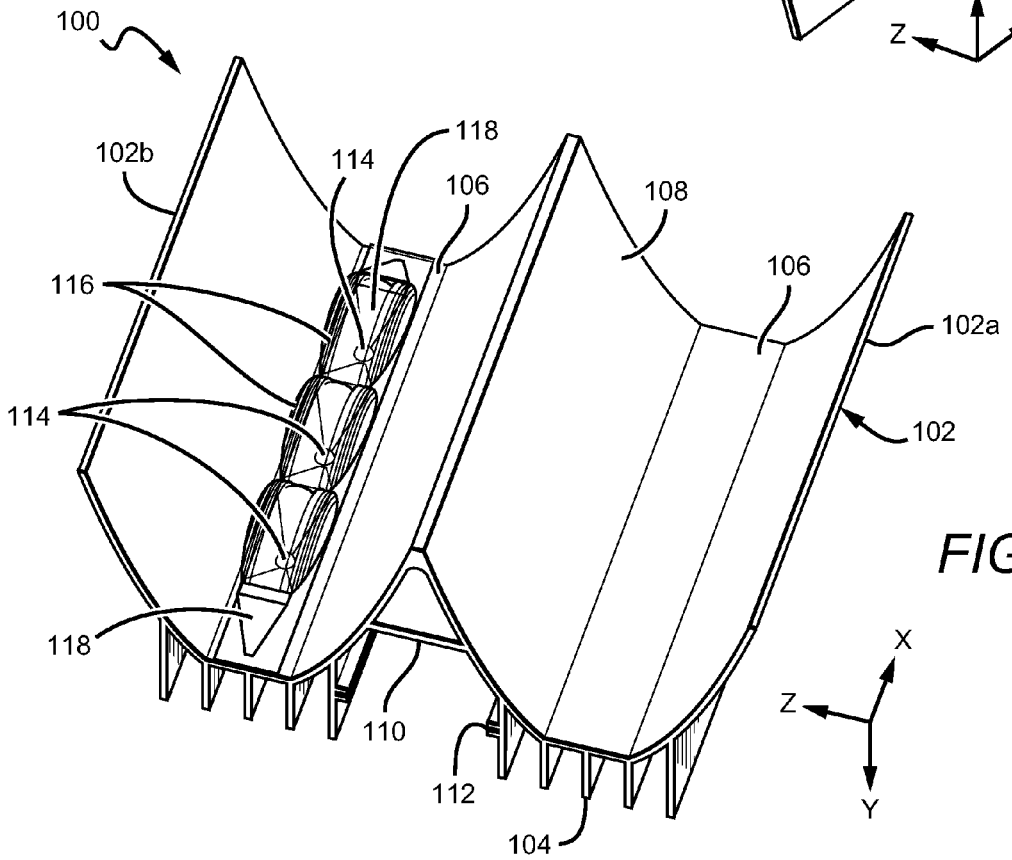
FIG. 2

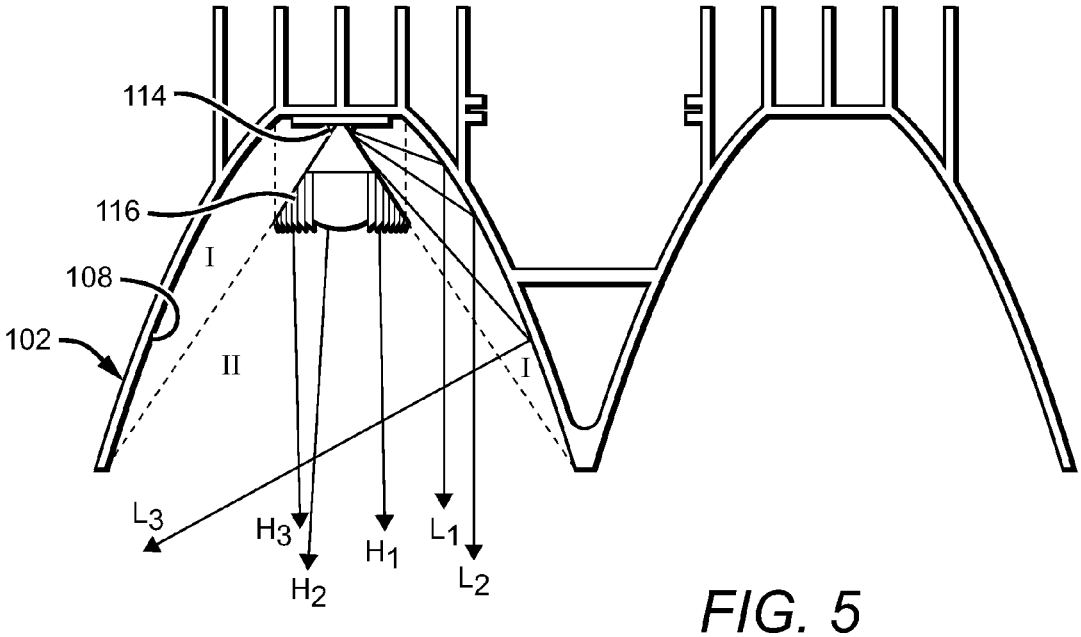
FIG. 5
FIG. 6
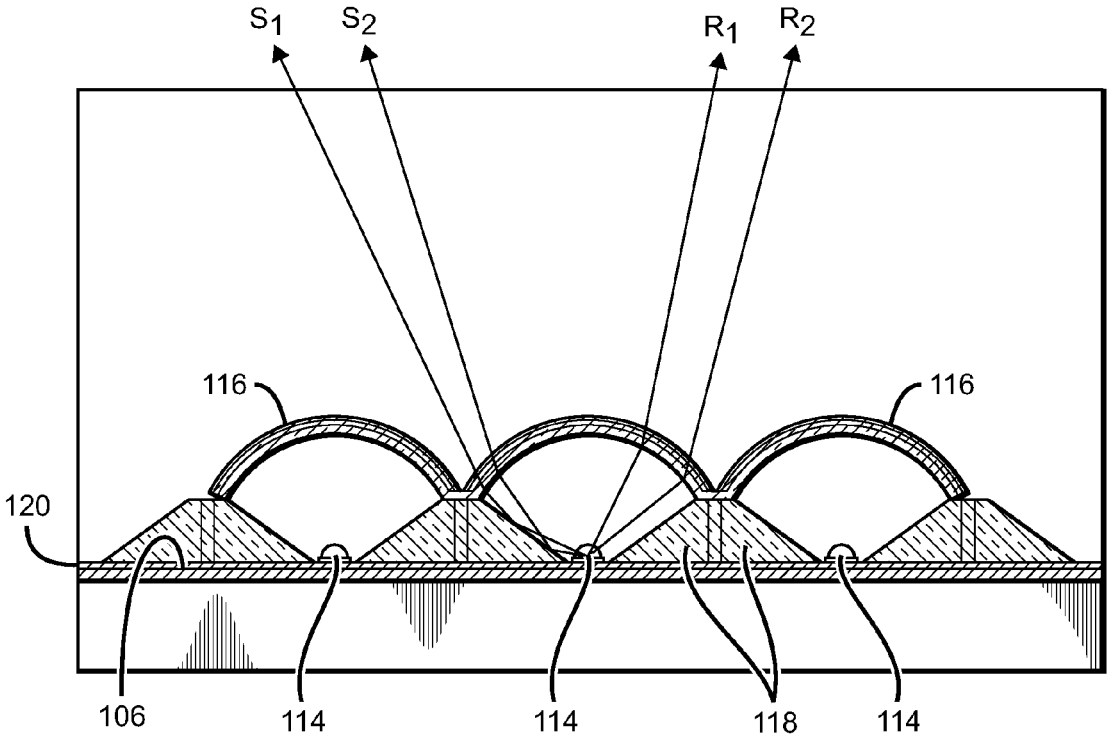

DIRECT AISLE LIGHTER

BACKGROUND OF THE INVENTION

1. Field of the Invention

The invention relates to lighting fixtures and, more particularly, to direct lighting fixtures that are well-suited for use with solid state lighting sources, such as light emitting diodes (LEDs).

2. Description of the Related Art

Light emitting diodes (LEDs) are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs, by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Typical direct view lamps, which are known in the art, emit both uncontrolled and controlled light. Uncontrolled light is light that is directly emitted from the lamp without any reflective bounces to guide it. According to probability, a portion of the uncontrolled light is emitted in a direction that is useful for a given application. Controlled light is directed in a certain direction with reflective or refractive surfaces. The mixture of uncontrolled and controlled light defines the output beam profile.

Also known in the art, a retroreflective lamp arrangement, such as a vehicle headlamp, utilizes multiple reflective surfaces to control all of the emitted light. That is, light from the source either bounces off an outer reflector (single bounce) or it bounces off a retroreflector and then off of an outer reflector (double bounce). Either way the light is redirected before emission and, thus, controlled. In a typical headlamp application, the source is an omni-emitter, suspended at the focal point of an outer reflector. A retroreflector is used to reflect the light from the front hemisphere of the source back through the envelope of the source, changing the source to a single hemisphere emitter.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Many modern lighting applications demand high power LEDs for increased brightness. High power LEDs can draw large currents, generating significant amounts of heat that must be managed. Many systems utilize heat sinks which must be in good thermal contact with the heat-generating light sources. Some applications rely on cooling techniques such as heat pipes which can be complicated and expensive.

Some lighting fixtures are configured to function in retail environments as aisle lighters. Most of these designs use typical high-intensity discharge or fluorescent lamps. Aisle lighter designs range from simple reflectors to complex optics, all of which are designed to distribute light evenly across merchandise that is arranged on shelves along aisles in a retail/industrial space.

SUMMARY OF THE INVENTION

Embodiments of a lighting fixture comprise the following elements. An elongated housing comprises a first heat sink, first and second opposing side reflectors, and a first interior mount surface on the first heat sink and between the first and second side reflectors. At least one light source is on the mount surface. At least one optical element is over the at least one light source. A plurality of reflective elements is on the mount surface on both sides of the at least one light source to redirect light emitted in the longitudinal direction.

Embodiments of a dual lighting fixture comprise the following elements. An elongated housing comprises: two pairs of inner and outer side reflectors, the inner side reflectors facing the outer side reflectors, the pairs of inner and outer side reflectors connected to each other in a parallel configuration along a longitudinal direction; a plurality of interior mount surfaces, one of the mount surfaces between each pair of inner and outer side reflectors; a plurality of heat sinks, one of the heat sinks between each pair of inner and outer side reflectors and opposite the mount surface; and a connector beam between said inner side reflectors.

Embodiments of a scalable lighting fixture comprise the following elements. A plurality of elongated housings each of which comprises: a heat sink; a pair of opposing side reflectors extending away from the heat sink; and an interior mount surface on the heat sink and between the side reflectors. Adjacent elongated housings are connected, such that the elongated housings are parallel to one another in a longitudinal direction.

BRIEF DESCRIPTION OF THE DRAWINGS

FIG. 1 is a perspective view of a lighting fixture according to an embodiment of the present invention.

FIG. 2 is a perspective view of a lighting fixture according to an embodiment of the present invention

FIG. 5 is a side perspective view of a lighting fixture according to an embodiment of the present invention.

FIG. 6 is a cross-sectional view of a close-up portion of a lighting fixture that may be used in embodiments of the present invention.

DETAILED DESCRIPTION OF THE INVENTION

Figure 3:
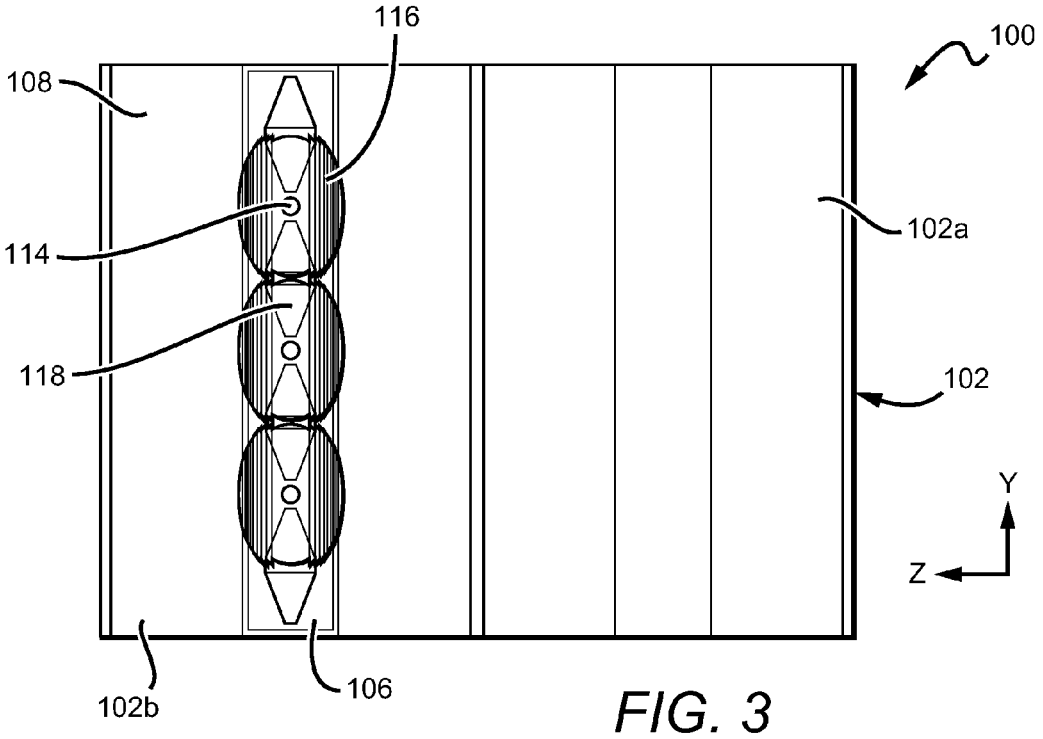
FIG. 3 is a perspective bottom view of a lighting fixture according to an embodiment of the present invention.

Embodiments of the present invention provide a direct lighting fixture that is well-suited for use with solid state light sources, such as LEDs, and particularly useful for lighting aisles in commercial and industrial environments. An elongated housing comprises several integral elements including a heat sink, opposing side reflectors, and a mount surface. A plurality of light sources is disposed on the mount surface. Each light source or cluster of sources has an optical element such as a lens over it to redirect a portion of the light emitted from the sources in a desired direction, for example, to collimate the light. Reflective elements are placed on both sides of each light source or cluster to redirect light that is initially emitted in a longitudinal direction. The fixture may comprise multiple elongated housings connected together and aligned in parallel along the longitudinal direction. The fixture may also be scalable.

Embodiments of the present invention are described herein with reference to conversion materials, wavelength conversion materials, remote phosphors, phosphors, phosphor layers and related terms. The use of these terms should not be construed as limiting. It is understood that the use of the term remote phosphors, phosphor or phosphor layers is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of layers can be different, and variations from the shapes of the illustrations as a result, for example, of manufacturing techniques and/or tolerances are expected. Thus, the regions illustrated in the figures are schematic in nature and their shapes are not intended to illustrate the precise shape of a region of a device and are not intended to limit the scope of the invention.

FIG. 1 is a perspective view of a lighting fixture 100 according to an embodiment of the present invention. An elongated housing 102 extends along a longitudinal direction (x-direction). In this particular embodiment, the housing 102 includes two substructures 102*a*, 102*b* in which light sources can be disposed. Other embodiments may include additional substructures which can be permanently connected (e.g., as a part of a monolithic structure) or removably connected, providing scalability.

In one embodiment, the housing 102 measures 4 inches in length (i.e., along the longitudinal direction). The fixtures may be joined end-to-end to create longer fixtures if necessary. 4 inches is merely an exemplary length. Many other lengths for the base housing components are certainly possible.

Each substructure 102*a*, 102*b* comprises a heat sink 104 to help dissipate heat generated by light sources (not shown in this view). Heat sink structures are known in the art and therefore only briefly discussed herein. A mount surface 106 is on the heat sink 104 on the interior side of the housing 102. The mount surface 106 provides a planar surface on which the light sources may be disposed. The mount surface 106 is on and in good thermal contact with heat sink 104 to provide a thermal path from the light sources to the ambient environment. Each substructure 102*a*, 102*b* further comprises a pair of opposing side reflectors 108 that extend away from the heat sink 104 to create a tunnel-like interior cavity. The side reflectors 108 are positioned such that light emitted from the light sources is redirected out of the fixture as a coarse adjustment (i.e., reduction) in the width of the outgoing beam. Some embodiments may include and enclosed or enclosable space for containing a power supply and/or routing wires for end-to-end attachment.

In this embodiment, the two substructures 102*a*, 102*b* are connected along one of the edges of two adjacent side reflectors 108 and also with connector beam 110. The connector beam 110 provides additional mechanical support and also a planar surface on which additional elements may be disposed such as a fan, wiring, or electronic components, for example.

The housing 102 also comprises mount slots 112 between the heat sinks 104. The slots 112 are designed to cooperate with an exterior structure either suspended from or attached to a ceiling. Thus, the housing 102 can be either surface mounted to the ceiling or hang mounted using chains and/or cords, for example. Many different exterior mount mechanisms may be used.

For ease of fabrication, the elongated housing 102 can be extruded from many different materials, with a suitable material being aluminum, for example. Other methods of fabrication are also possible, including die casting and molding. If a monolithic structure is used, the housing 102 may be formed from a thermally conductive material. In some embodiments, the interior surfaces of said side reflectors can be coated with a highly reflective material, such as a metal, for example.

FIG. 2 is a perspective view of the fixture 100 from a bottom side angle. FIG. 3 is a perspective bottom side view of the fixture 100. A plurality of light sources 114 is arranged on the mount surface 106. For ease of illustration, the light sources 114 are only shown in one of the substructures 102*a*, but it is understood that additional light sources may be similarly disposed in the other substructure 102*b* as well.

A plurality of optical elements 116 is on said mount surface 106 and over said light sources 114. Each optical element 114 is over a single light source 114; however, in other embodiments there may be a cluster of light sources under a single optical element. Here, the optical elements comprise collimating lenses as discussed in more detail herein.

Reflective elements 118 are also disposed along the mount surface 106 on both longitudinal sides of the light sources 114. These elements are designed to redirect light that is initially emitted from the sources 114 in the longitudinal direction down toward the open end of the fixture, concentrating the light output into the desired area (e.g., an aisle beneath the fixture). The reflective elements 118 may be constructed from any highly reflective material, such as aluminum, and should be shaped to efficiently redirect light emitted at low angles in the longitudinal direction. The reflective elements 118 may comprise a specularly reflective material. The reflective elements 118 may be mounted to the mount surface using, for example, screws or an adhesive.

FIG. 3 is a bottom perspective view of the fixture 100. The optical elements 116 are aligned along the mount surface 106 in the longitudinal direction. The optical elements 116 may be made of any light transmissive material depending on the desired refractive effect. The optical elements may be mounted separately, or they may be connected and mounted as a single piece.

Figure 4:
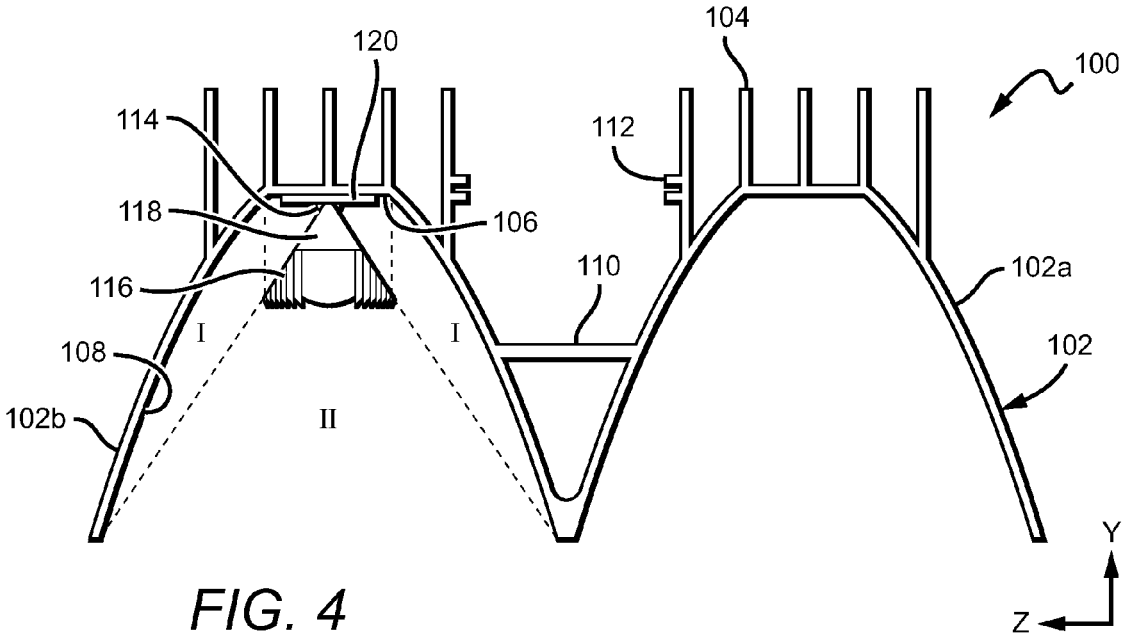
FIG. 4 is a side perspective view of a lighting fixture according to an embodiment of the present invention.

FIGS. 4 and 5 are side perspective views of the fixture 100. Here, the individual sources 114 are on a light strip 120 which is mounted to the mount surface 106. Light strips are discussed in more detail herein. Light from the sources that is initially emitted at a low angle (i.e., into region I) with a substantial transverse (z-direction) component will be redirected by the side reflectors 108 in a downward direction, away from the mount surface 106 and into the room area. Light that is initially emitted at higher angles (i.e., into region II) with a substantial transverse component will be redirected by the optical elements 116 in a direction toward the open end of the housing 102. Thus, light that would have otherwise been emitted from the housing 102 as uncontrolled light is controlled, in this case collimated, by the optical elements 116. Light that is emitted having a substantial longitudinal component will impinge on the reflective elements 118 and be redirected into the optical elements 116 and then down toward the open end of the housing 102. In this particular embodiment, the combined effect of the side reflectors 108, the optical elements 116, and the reflective elements 118 is a relatively collimated output beam that is confined in the longitudinal direction. Such a beam is desirable for lighting a narrow area beneath the fixture 100, such as an aisle.

In FIG. 5, several rays are traced to illustrate how light emitted from the sources 114 at certain angles interacts with the various features of the fixture 100. For simplification all the rays shown are emitted in the transverse direction. As described herein, light rays $L_1$, $L_2$, $L_3$ emitted at low angles impinge on the side reflectors 108 and are redirected downward toward the open end of the housing 102. Light rays $H_1$, $H_2$, $H_3$ emitted at higher angles interact with the optical element 116 and are also redirected downward as shown. Light ray $L_3$ represents light which will exit the housing 102 with the highest escape angle, defining the width of the beam. In this particular embodiment, the total beam width is significantly reduced due to the collimating effect of the optical elements 116. It is understood that many different optical elements are possible to achieve a particular output beam profile.

FIG. 6 is a cross-sectional view of a portion of the fixture 100. The light sources 114 are on a light strip 120 that is mounted to the mount surface 106. Each source 114 is under one of the optical elements 116 and in between the reflective elements 118. Several light rays are modeled to show some exemplary light paths. For simplification all the rays shown are emitted in the longitudinal direction. Rays $S_1$, $S_2$ emitted at lower angles are redirected by the reflective element 118 toward the optical element 116. Rays $R_1$, $R_2$ emitted at higher angles are redirected by the optical element 116. However, all of the rays are collimated to some degree by the optical element 116 as they pass through, providing extra beam control. Many different optical elements and reflective elements may be used in combination to tailor the output beam profile.

Figure 7A:
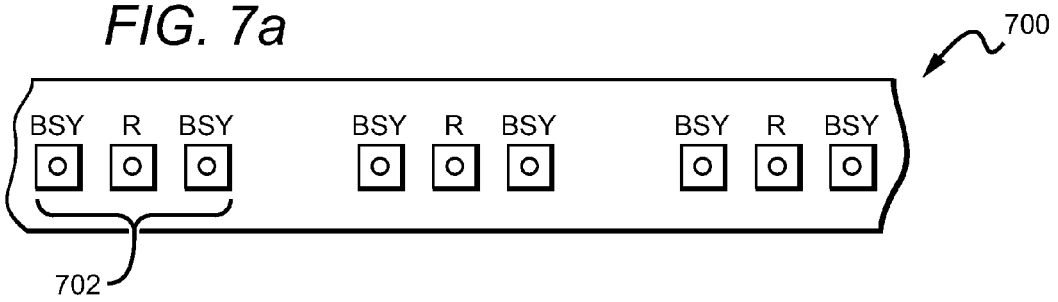
FIGS. 7*a-c* are top schematic views of portions of several light strips that may be used in fixtures according to embodiments of the present invention.
Figure 7B:
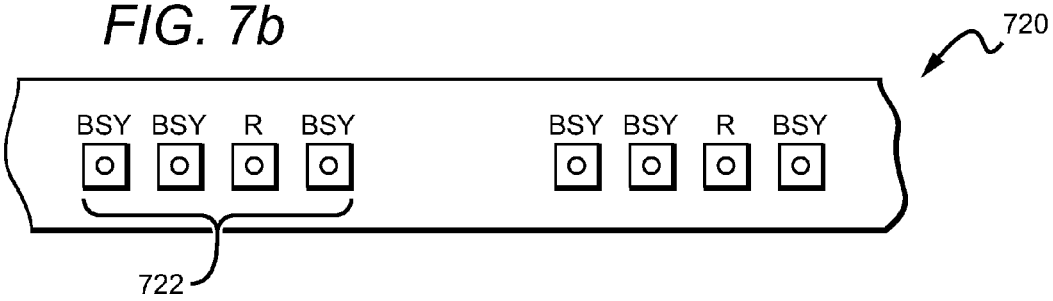
Figure 7C:
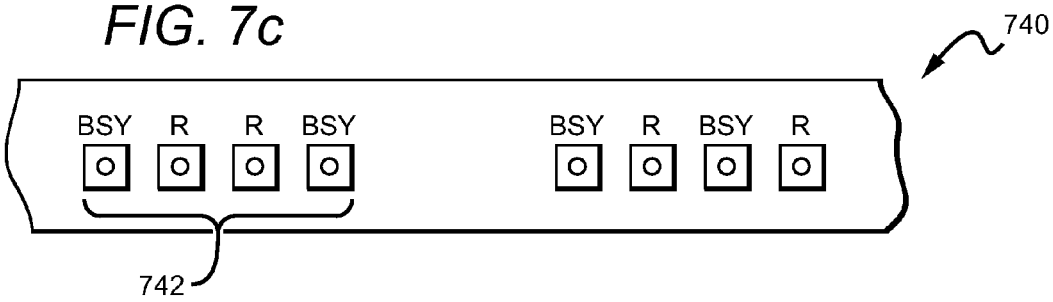

The mount surface 106 provides a substantially flat area on which one or more light sources can be mounted. In some embodiments, the light source(s) will be pre-mounted on light strips, such as a printed circuit board (PCB). FIGS. 7*a-c* show a top view of portions of several light strips 700, 720, 740 that may be used to mount multiple LEDs to the mount surface 106. Although LEDs are used as the light sources in various embodiments described herein, it is understood that other light sources, such as laser diodes for example, may be substituted in as the light sources in other embodiments of the invention.

Many industrial, commercial, and residential applications call for white light sources. Embodiments of the lighting fixtures disclosed herein may comprise one or more emitters producing the same color of light or different colors of light. In one embodiment, a multicolor source is used to produce white light. Several colored light combinations will yield white light. For example, as discussed in U.S. Pat. Nos. 7,213,940 and 7,768,192, both of which are assigned to Cree, Inc., and both of which are incorporated herein by reference, it is known in the art to combine light from a blue LED with wavelength-converted yellow light to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several color combinations are described in detail in patents to Van de Ven (U.S. Pat. Nos. 7,213,940 and 7,768,192; both also owned by Cree, Inc.) which are incorporated by reference herein.

The light strips 700, 720, 740 each represent possible LED combinations that result in an output spectrum that can be mixed to generate white light. Each lighting strip can include the electronics and interconnections necessary to power the LEDs. In some embodiments the light strip comprises a PCB with the LEDs mounted and interconnected thereon. The light strip 700 includes clusters 702 of discrete LEDs, with each LED within the cluster 702 spaced a distance from the next LED, and each cluster 702 spaced a distance from the next cluster. If the LEDs within a cluster are spaced at too great distance from one another, the colors of the individual sources may become visible, causing unwanted color-striping. In some embodiments, an acceptable range of distances for separating consecutive LEDs within a cluster is not more than approximately 8 mm.

The scheme shown in FIG. 7*a* uses a series of clusters 702 having two blue-shifted-yellow LEDs ("BSY") and a single red LED ("R"). BSY refers to a color created when blue LED light is wavelength-converted by a yellow phosphor. The resulting output is a yellow-green color that lies off the black body curve. BSY and red light, when properly mixed, combine to yield light having a "warm white" appearance.

The lighting strip 720 includes clusters 722 of discrete LEDs. The scheme shown in FIG. 7*b* uses a series of clusters 722 having three BSY LEDs and a single red LED. This scheme will also yield a warm white output when sufficiently mixed.

The lighting strip 740 includes clusters 742 of discrete LEDs. The scheme shown in FIG. 7*c* uses a series of clusters 742 having two BSY LEDs and two red LEDs. This scheme will also yield a warm white output when sufficiently mixed.

The lighting schemes shown in FIGS. 7*a-c* are meant to be exemplary. Thus, it is understood that many different LED combinations can be used in concert with known conversion techniques to generate a desired output light color.

Figure 8:
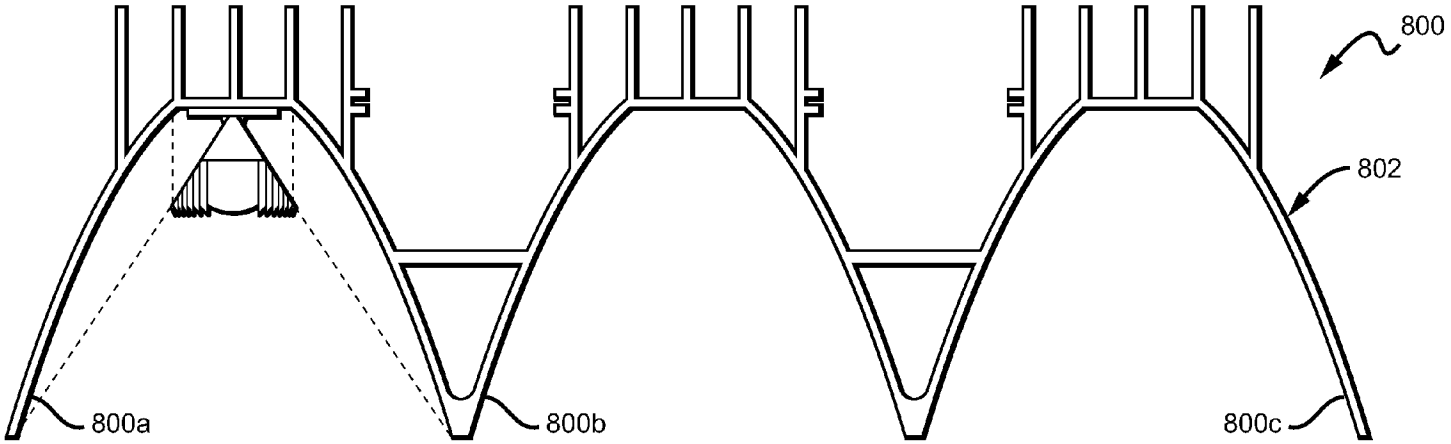
FIG. 8 is a side perspective view of a lighting fixture according to embodiments of the present invention.

FIG. 8 is a side perspective view of a lighting fixture 800 according to an embodiment of the present invention. The fixture 800 is similar to the fixture 100 shown in FIG. 1. However, in the fixture 800 an elongated housing 802 comprises three substructures 800*a*, 800*b*, 800*c*. Other embodiments may contain more or fewer than three substructures. Thus, lighting fixtures disclosed herein are easily scalable to accommodate wider room areas. In some embodiments, additional substructures can be added to the design and simply fabricated as part of a monolithic housing structure, such as by extrusion, for example.

Figure 9:
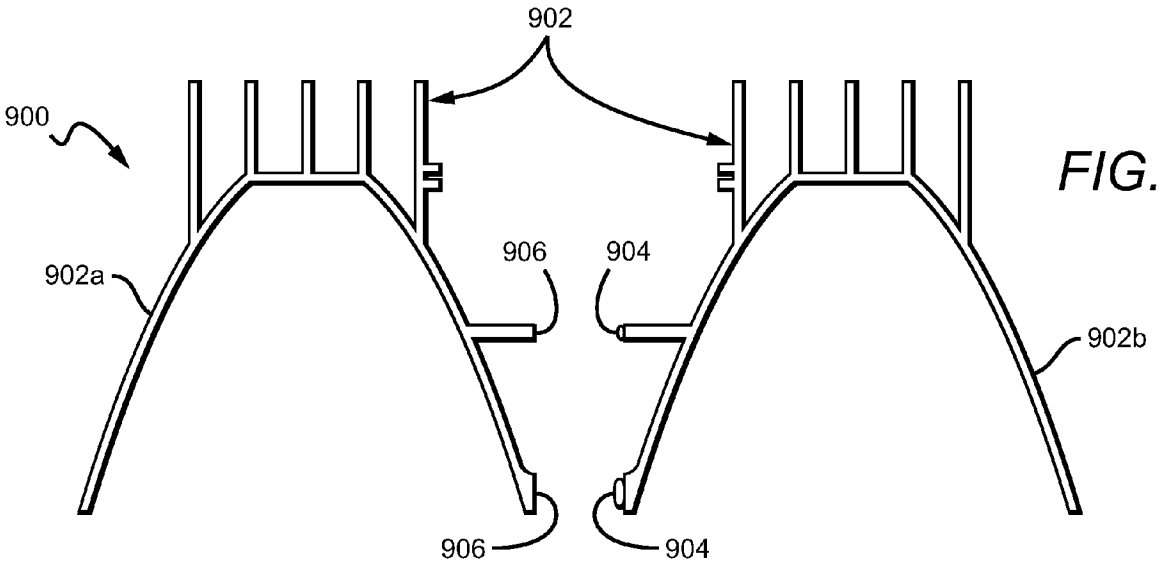
FIG. 9 is a side perspective view of a lighting fixture according to embodiments of the present invention.

In other embodiments, additional substructures may be removably attached to create a modular fixture that is scalable at the point of use. FIG. 9 is a side perspective view of a fixture 900 according to an embodiment of the present invention. An elongated housing 902 comprises substructures 902*a*, 902*b* that are removably connectable to each other. The substructure may be connectable using many different attachment mechanisms. One suitable attachment mechanism is a snap-fit structure in which one substructure 902*b* has male components 904 that are designed to cooperate with female components 906 on the other substructure 902*a*. The snap-fit structure is only one example of an attachment mechanism; many other attachment mechanisms may also be used. It is understood that additional substructures may be added in a similar manner such that the fixture 900 is easily scalable, providing a system that is customizable post-manufacture.

It is understood that embodiments presented herein are meant to be exemplary. Embodiments of the present invention can comprise any combination of compatible features shown in the various figures, and these embodiments should not be limited to those combinations expressly illustrated and discussed. Although the present invention has been described in detail with reference to certain configurations thereof, other versions are possible. Therefore, the spirit and scope of the invention should not be limited to the versions described above.

We claim:

1. A lighting fixture, comprising:

an elongated housing, said housing comprising:

a first heat sink;

first and second opposing side reflectors; and a first interior mount surface on said first heat sink and between said first and second side reflectors, wherein said mount surface connects said first and second side reflectors;

at least one light source on said mount surface;

at least one optical element over said at least one light source; and a plurality of reflective elements on said mount surface to redirect light emitted in the longitudinal direction.

2. The lighting fixture of claim 1, wherein said heat sink, said interior mount surface, and said first and second side reflectors are all integral to said housing.

3. The lighting fixture of claim 1, wherein said at least one optical element comprises a collimating lens.

4. The lighting fixture of claim 1, said elongated housing open at both longitudinal ends.

5. The lighting fixture of claim 1, said elongated housing comprising an external mount feature.

6. A lighting fixture, comprising an elongated housing, said housing comprising:

a first heat sink;

first and second opposing side reflectors; and a first interior mount surface on said first heat sink and between said first and second side reflectors, wherein said mount surface connects said first and second side reflectors;

at least one light source on said mount surface;

at least one optical element over said at least one light source; and a plurality of reflective elements on said mount surface to redirect light emitted in the longitudinal direction;

said elongated housing further comprising:

a second heat sink parallel to said first heat sink;

third and fourth opposing side reflectors; and a second interior mount surface on said second heat sink and between said third and fourth side reflectors.

7. The lighting fixture of claim 6, wherein one of said first and second side reflectors is joined to one of said third and fourth side reflectors such that said first and second mount surfaces face the same direction and are parallel with each other along the longitudinal direction.

8. The lighting fixture of claim 6, further comprising a connector beam extending between the two side reflectors that are joined.

9. The lighting fixture of claim 6, said elongated housing comprising opposing mount slots between said first and second heat sinks.

10. The lighting fixture of claim 6, wherein said elongated fixture is a monolithic structure.

11. A dual lighting fixture, comprising:

an elongated housing, said housing comprising:

two pairs of inner and outer side reflectors, said inner side reflectors facing said outer side reflectors, said pairs of inner and outer side reflectors connected to each other in a parallel configuration along a longitudinal direction;

a plurality of interior mount surfaces, one of said mount surfaces between and adjacent to each pair of inner and outer side reflectors;

a plurality of heat sinks, one of said heat sinks between and adjacent to each pair of inner and outer side reflectors and opposite said mount surface; and a connector beam between said inner side reflectors.

12. The dual lighting fixture of claim 11, wherein said elongated housing is a monolithic structure.

13. The dual lighting fixture of claim 11, further comprising a plurality of light sources on said mount surfaces such that at least some light emitted from said light sources interacts with said side reflectors.

14. The dual lighting fixture of claim 13, further comprising a plurality of optical elements on said mount surfaces, each optical element over at least one of said light sources.

15. The dual lighting fixture of claim 14, wherein said at least one optical element comprises a collimating lens.

16. The dual lighting fixture of claim 13, further comprising a plurality of reflective elements on said mount surfaces on both sides of said at least one light source to redirect light emitted in the longitudinal direction.

17. The dual lighting fixture of claim 11, said elongated housing comprising an external mount feature.

18. A scalable lighting fixture, comprising:

a plurality of elongated housings, each of said housings comprising:

a heat sink;

a pair of opposing side reflectors extending away from said heat sink; and an interior mount surface on said heat sink and between and adjacent to said side reflectors;

wherein adjacent ones of said elongated housings are connected, such that the elongated housings are parallel to one another in a longitudinal direction.

19. The scalable lighting fixture of claim 18, wherein said plurality of elongated fixtures comprise a single monolithic structure.

20. The scalable lighting fixture of claim 18, further comprising a plurality of light sources on each of said mount surfaces.

21. The scalable lighting fixture of claim 20, further comprising a plurality of lenses on each of said mount surfaces, each of said lenses covering at least one of said light sources.

22. The scalable lighting fixture of claim 20, further comprising a plurality of reflective elements on said mount surfaces, said reflective elements on both longitudinal sides of each of said light sources such that at least some light emitted from said light sources interacts with said side reflectors.

23. The scalable lighting fixture of claim 18, wherein adjacent ones of said elongated housings are connected by an edge common to adjacent side reflectors.

24. The scalable lighting fixture of claim 18, wherein adjacent ones of said elongated housings are connected by a connector beam extending between adjacent side reflectors.

25. The scalable lighting fixture of claim 18, wherein adjacent ones of said elongated housings are removably connected to one another.

* * * * *